US009327382B2

(12) United States Patent
Ueno et al.

(10) Patent No.: US 9,327,382 B2
(45) Date of Patent: May 3, 2016

(54) CARRIER FOR A DOUBLE-SIDE POLISHING APPARATUS, DOUBLE-SIDE POLISHING APPARATUS USING THIS CARRIER, AND DOUBLE-SIDE POLISHING METHOD

(75) Inventors: Junichi Ueno, Nishishirakawa (JP); Kazuya Sato, Nishishirakawa (JP); Syuichi Kobayashi, Nishishirakawa (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 1025 days.

(21) Appl. No.: 12/863,674

(22) PCT Filed: Feb. 16, 2009

(86) PCT No.: PCT/JP2009/000592
§ 371 (c)(1),
(2), (4) Date: Jul. 20, 2010

(87) PCT Pub. No.: WO2009/107333
PCT Pub. Date: Sep. 3, 2009

(65) Prior Publication Data

US 2011/0104995 A1 May 5, 2011

(30) Foreign Application Priority Data

Feb. 27, 2008 (JP) ..... 2008-045479

(51) Int. Cl.
*B24B 37/04* (2012.01)
*B24B 37/08* (2012.01)
(Continued)

(52) U.S. Cl.
CPC ..... *B24B 37/28* (2013.01); *B24B 37/042* (2013.01); *B24B 37/08* (2013.01)

(58) Field of Classification Search
CPC ..... B24B 37/04; B24B 37/042; B24B 37/08; B24B 37/10; B24B 37/102; B24B 37/27; B24B 37/28; B24B 37/30; B24B 37/32
USPC ..... 451/41, 285, 286, 287, 288, 290, 397, 451/398
See application file for complete search history.

(56) References Cited

U.S. PATENT DOCUMENTS 5,081,421 A * 1/1992 Miller et al. ..... 324/671
5,308,661 A * 5/1994 Feng et al. ..... 427/535
(Continued)

FOREIGN PATENT DOCUMENTS

CN 1993206 A 7/2007
CN 101128920 A 2/2008
(Continued)

OTHER PUBLICATIONS

International Search Report issued in International Patent Application No. PCT/JP2009/000592, dated May 12, 2009.
(Continued)

*Primary Examiner* — Eileen Morgan
(74) *Attorney, Agent, or Firm* — Oliff PLC

(57) ABSTRACT

A carrier for a double-side polishing apparatus comprising at least: a metallic carrier base that is arranged between upper and lower turn tables having polishing pads attached thereto and has a holding hole formed therein to hold a wafer sandwiched between the upper and lower turn tables at the time of polishing; and a ring-like resin insert that is arranged along an inner peripheral portion of the holding hole of the carrier base and is in contact with a peripheral portion of the held wafer, wherein an inner peripheral end portion of the holding hole of the carrier base has an upwardly opening tapered surface, an outer peripheral portion of the ring-like insert has a reverse tapered surface with respect to the tapered surface of the holding hole of the carrier base, and the resin insert is fitted in the holding hole of the carrier base through the tapered surface.

19 Claims, 3 Drawing Sheets

(51) Int. Cl.
*B24B 37/28* (2012.01)
*B24B 37/32* (2012.01)

(56) References Cited

U.S. PATENT DOCUMENTS

| | | | | |
|---|---|---|---|---|
| 5,397,428 | A * | 3/1995 | Stoner et al. | 117/86 |
| 5,707,492 | A * | 1/1998 | Stager et al. | 438/693 |
| 5,731,046 | A * | 3/1998 | Mistry et al. | 427/553 |
| 6,042,688 | A * | 3/2000 | Masumura et al. | 156/345.14 |
| 6,290,584 | B1 * | 9/2001 | Kim et al. | 451/288 |
| 6,582,288 | B2 * | 6/2003 | Yeh et al. | 451/288 |
| 6,623,343 | B2 * | 9/2003 | Kajiwara et al. | 451/398 |
| 6,632,127 | B1 * | 10/2003 | Zimmer et al. | 451/285 |
| 6,705,806 | B2 * | 3/2004 | Okamura et al. | 407/119 |
| 6,710,857 | B2 * | 3/2004 | Kondo | 355/72 |
| 6,899,603 | B2 * | 5/2005 | Homma et al. | 451/57 |
| 6,918,824 | B2 * | 7/2005 | Marquardt et al. | 451/285 |
| 6,939,206 | B2 * | 9/2005 | Ashjaee et al. | 451/41 |
| 6,945,861 | B2 * | 9/2005 | Boo et al. | 451/285 |
| 2003/0008602 | A1 * | 1/2003 | Ashjaee et al. | 451/54 |
| 2004/0198193 | A1 * | 10/2004 | Tajima et al. | 451/41 |
| 2005/0202758 | A1 | 9/2005 | Yoshida et al. | |
| 2008/0166952 | A1 * | 7/2008 | Ueno | 451/41 |
| 2008/0318493 | A1 * | 12/2008 | Aida | 451/36 |
| 2009/0305615 | A1 | 12/2009 | Uchiyama | |

FOREIGN PATENT DOCUMENTS

| | | |
|---|---|---|
| JP | A-2000-24912 | 1/2000 |
| JP | A-2003-305637 | 10/2003 |
| JP | A-2004-303280 | 10/2004 |
| JP | A-2005-254351 | 9/2005 |
| JP | A-2006-303136 | 11/2006 |
| JP | A-2008-23617 | 2/2008 |

OTHER PUBLICATIONS

International Preliminary Report on Patentability issued in International Application No. PCT/JP2009/000592 on Oct. 5, 2010 (with translation).

Sep. 15, 2011 Office Action issued in Chinese Patent Application No. 200980106528.4 (with partial translation).

* cited by examiner

CARRIER FOR A DOUBLE-SIDE POLISHING APPARATUS, DOUBLE-SIDE POLISHING APPARATUS USING THIS CARRIER, AND DOUBLE-SIDE POLISHING METHOD

TECHNICAL FIELD

The present invention relates to a carrier for a double-side polishing apparatus that holds, e.g., a semiconductor wafer when polishing the semiconductor wafer in a double-side polishing apparatus.

BACKGROUND ART

For example, when simultaneously polishing both surfaces of a semiconductor wafer, a carrier is utilized to hold the semiconductor wafer. This carrier is formed to have a thickness smaller than that of the semiconductor wafer and includes a holding hole that is utilized to hold the wafer at a predetermined position between an upper turn table and a lower turn table of a double-side polishing apparatus. The semiconductor wafer is inserted into and held in this holding hole, upper and lower surfaces of the semiconductor wafer are sandwiched between respective polishing instruments such as polishing pads provided on opposed surfaces of the upper turn table and the lower turn table, and polishing is carried out while supplying a polishing agent to surfaces to be polished.

Here, as the carrier utilized for double-side polishing in such a semiconductor wafer polishing process, a metal carrier is a mainstream.

Therefore, a resin insert is disposed along an inner peripheral portion of the holding hole to protect a wafer peripheral portion against damages caused by the metal carrier. In conventional examples, to prevent this resin insert from coming off during processing of the semiconductor wafer or conveyance when disposing it, an outer peripheral portion of the resin insert may be formed into a wedge shape and fitted into a carrier base to be further fixed by an adhesive in some cases (see JP-A 2000-24912 (KOKAI)).

Although this wedge shape is hollowed out from a plate material by laser beam machining, expansion or constriction occurs due to heat so that fitting may be tight when disposing the resin insert to the carrier base, whereby a wedge shape of the carrier base portion may be deformed in some cases.

To eliminate such deformation when disposing the resin insert, a process such as lapping for the carrier must be carried out after disposing the resin insert, and the lapping process cannot be performed when the carrier to be used is a coated carrier.

There is a problem that, when the carrier deformed by disposing the resin insert is utilized to polish the semiconductor wafer, a shape of the polished wafer is degraded.

Further, although a method of performing start-up polishing for the carrier in place of the lapping process can be considered, a longer time is required as compared with the lapping process and productivity is degraded in case of polishing, and accurately eliminating the deformation is difficult.

DISCLOSURE OF INVENTION

Therefore, in view of the above-described problems, it is an object of the present invention to provide a carrier for a double-side polishing apparatus, a double-side polishing apparatus using this carrier, and a double-side polishing method that enable producing a wafer having high flatness without damaging a carrier base at the time of disposing a resin insert when used for polishing.

To achieve this object, according to the present invention, there is provided a carrier for a double-side polishing apparatus comprising at least: a metallic carrier base that is arranged between upper and lower turn tables having polishing pads attached thereto and has a holding hole formed therein to hold a wafer sandwiched between the upper and lower turn tables at the time of polishing; and a ring-like resin insert that is arranged along an inner peripheral portion of the holding hole of the carrier base and is in contact with a peripheral portion of the held wafer, wherein an inner peripheral end portion of the holding hole of the carrier base has an upwardly opening tapered surface, an outer peripheral portion of the ring-like insert has a reverse tapered surface with respect to the tapered surface of the holding hole of the carrier base, and the resin insert is fitted in the holding hole of the carrier base through the tapered surface.

According to such a carrier for a double-side polishing apparatus, since the resin insert is fitted into the holding hole of the carrier base through the tapered surface when disposing the resin insert, the resin insert is prevented from coming off, disposing can be easily carried out, and the carrier base is not damaged at the time of disposing, whereby the carrier base is not deformed. Therefore, effecting double-side polishing by using the carrier according to the present invention enables providing a semiconductor wafer having high flatness. Furthermore, when performing start-up process of the carrier, the polishing does not have to be carried out until deformation of the metallic carrier base is eliminated, and therefore a start-up polishing time can be greatly reduced, which leads to an improvement in productivity of the semiconductor wafer.

Moreover, since attachment/detachment of the resin insert can be easily effected, replacement of the resin insert alone can be easily performed, thereby reducing a cost.

Additionally, when the tapered shape is provided, since the resin insert portion that can be observed on a lower turn table side of the carrier is small, an amount of polishing the resin insert on the lower turn table side is small at the time of polishing, thus greatly increasing a life of the resin insert.

At this time, it is preferable for the tapered surface of the holding hole to be inclined at 5° to 85° from a main surface of the carrier base.

When the inclination angle in this range is utilized, the resin insert hardly comes off during polishing or conveyance.

At this time, it is preferable for the tapered surface of the holding hole and the reverse tapered surface of the resin insert to be fixed through an adhesive.

Fixing the tapered surfaces through the adhesive in this manner enables assuredly preventing the resin insert from coming off during polishing or conveyance, thus facilitating handling of the carrier for a double-side polishing apparatus according to the present invention.

Further, it is preferable for the carrier having the resin insert fitted in the holding hole of the carrier base to be subjected to double-side polishing.

When the carrier is previously subjected to double-side polishing with the resin insert being fitted before polishing the semiconductor wafer, the resin insert and the carrier base can have the same thickness to assuredly eliminate a step, and a further flat wafer can be obtained by effecting subsequent polishing with respect to the wafer. Furthermore, since deformation of the carrier base due to disposing the resin insert does not occur in the carrier for a double-side polishing apparatus according to the present invention, substantially polishing the resin insert portion alone enables starting up the carrier, and the processing can be performed in a short time, thereby improving productivity on producing the semiconductor wafer.

Moreover, it is preferable for a material of the carrier base to be titanium.

When the material of the carrier base is titanium as described above, since titanium itself has a small diffusion coefficient in the semiconductor wafer formed of, e.g., silicon, it rarely becomes a problem as an impurity, and a metal impurity having a large diffusion coefficient such as Fe is not present in titanium, thus suppressing contamination of a metal impurity with respect to the semiconductor wafer.

Additionally, it is preferable for a surface of the metallic carrier base to be coated with any one of a titanium nitride film and a DLC film.

As described above, when the surface of the metallic carrier base is coated with one of the titanium nitride film and the DLC (Diamond Like Carbon) film, hardness increases to hardly make scratches, foreign particles can be suppressed from falling into the polishing slurry, thus prolonging the carrier life and suppressing contamination with respect to the wafer.

Further, a double-side polishing apparatus including at least a carrier for a double-side polishing apparatus according to the present invention is preferable.

As described above, according to the double-side polishing apparatus including the carrier for a double-side polishing apparatus of the present invention, polishing can be effected with excellent productivity, and the semiconductor wafer having high flatness can be provided.

Furthermore, a semiconductor wafer double-side polishing method that is a method for performing double-side polishing with respect to a semiconductor wafer is preferred, the method comprising: arranging the carrier according to the present invention between upper and lower turn tables having polishing pads attached thereto; holding the semiconductor wafer in a holding hole formed in the carrier; and sandwiching the semiconductor wafer between the upper and lower turn tables to be subjected to double-side polishing.

When the semiconductor wafer is held in the holding hole of the carrier for a double-side polishing apparatus according to the present invention to effect double-side polishing based on such a method, polishing can be carried out with excellent productivity, thereby providing the semiconductor wafer having high flatness.

As described above, since the carrier for a double-side polishing apparatus according to the present invention enables easily disposing the resin insert to the carrier base without damages, thus avoiding deformation of the carrier base at the time of disposing. Therefore, when the carrier according to the present invention is utilized to effect double-side polishing with respect to the wafer, the semiconductor wafer that has high flatness and an excellent shape in a wafer outer peripheral portion in particular can be provided, and the start-up polishing can be omitted or the polishing time can be reduced at the time of starting up the carrier, whereby the semiconductor wafer can be polished with excellent productivity. Additionally, since attachment/detachment of the resin insert is easy, replacement of the resin insert alone can be easily performed, thereby reducing a cost.

BEST MODE(S) FOR CARRYING OUT THE INVENTION

In a conventional carrier for a double-side polishing apparatus, when disposing a resin insert to a metallic carrier base, it is fitted into a tally portion having a wedge shape to avoid falling and fixed by using an adhesive to be disposed. However, there is a problem that the wedge shape of the carrier base is deformed during this fitting operation and the deformation affects subsequent operations.

Thus, the present inventors have conceived of a carrier for a double-side polishing apparatus having a configuration that a wedge shape of an outer peripheral portion of a resin insert is eliminated to provide a tapered shape, the resin insert is fitted through an upwardly opening tapered surface of an inner peripheral end portion of a holding hole of a carrier base, and the resin insert can be thereby disposed to the carrier base without damages because of each attachment while avoiding falling during processing and conveyance, thus bringing the present invention to completion.

Although an embodiment according to the present invention will now be described hereinafter in detail with reference to the drawings, the present invention is not restricted thereto.

Figure 1:
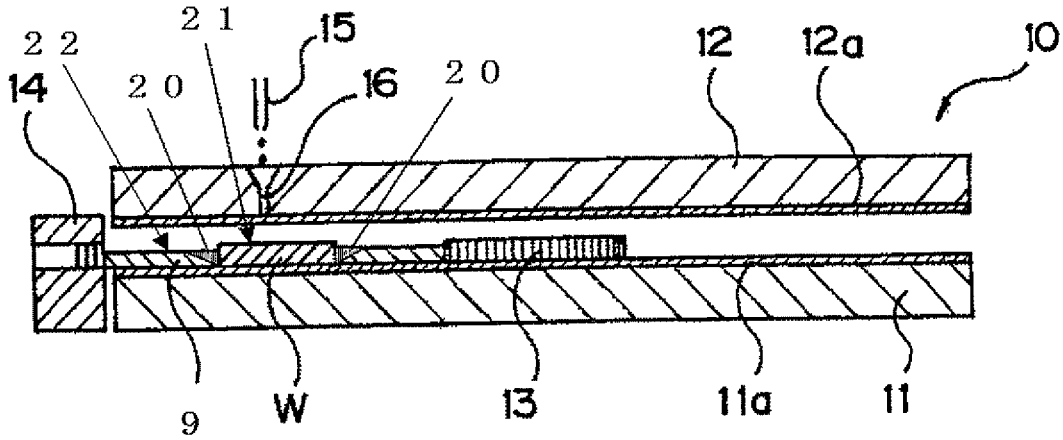
FIG. 1 is a vertical cross-sectional view showing an example of a double-side polishing apparatus including a carrier for a double-side polishing apparatus according to the present invention.
Figure 2:
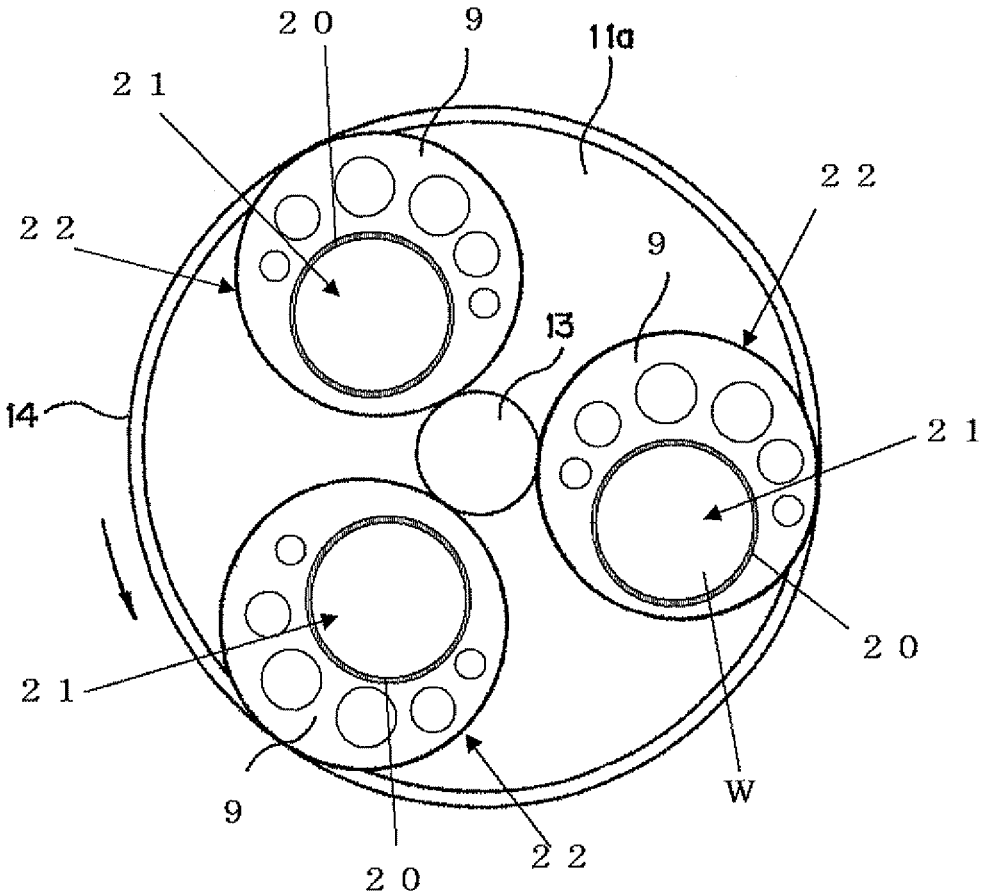
FIG. 2 is an internal structural view of the double-side polishing apparatus in the form of a planar view.
Figure 3:
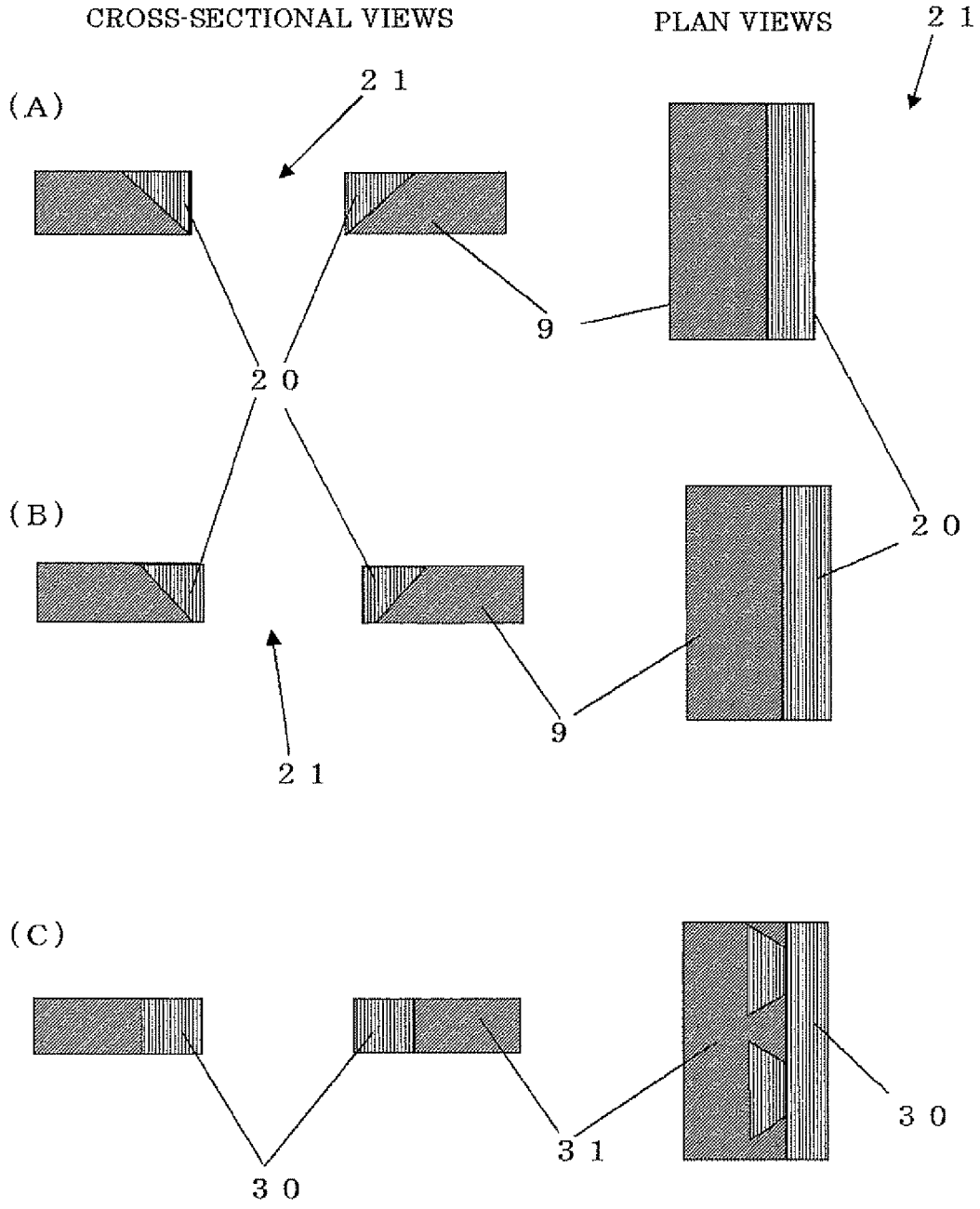
FIG. 3(A) shows an example of an enlarged cross-sectional view and a plan view of the carrier for a double-side polishing apparatus according to the present invention.
FIG. 3(B) shows another example of the enlarged cross-sectional view and the plan view of the carrier for a double-side polishing apparatus according to the present invention.
FIG. 3(C) is an enlarged cross-sectional view and a plan view of a conventional carrier for a double-side polishing apparatus.

Here, FIG. 1 is a cross-sectional view of a double-side polishing apparatus including a carrier for a double-side polishing apparatus according to the present invention, FIG. 2 is an internal structural view of the double-side polishing apparatus in the form of a planar view, and FIG. 3 are cross-sectional views and plan views of inner peripheral end portions of holding holes in a carrier according to the present invention and a conventional carrier.

First, in FIGS. 1 and 2, a double-side polishing apparatus 10 including a carrier for a double-side polishing apparatus 22 according to the present invention has a lower turn table 11 and an upper turn table 12 provided to face each other in a vertical direction, and polishing pads 11*a* and 12*a* are attached to opposed face sides of the respective turn tables 11 and 12. Further, a sun gear 13 is provided at a central portion between the upper turn table 12 and the lower turn table 11, and an internal gear 14 is provided at a peripheral portion. A semiconductor wafer W is held in a holding hole 21 of a carrier base 9 and sandwiched between the upper turn table 12 and the lower turn table 11.

Outer peripheral teeth of the carrier 22 mesh with respective tooth portions of the sun gear 13 and the internal gear 14, and each carrier 22 moves around the sun gear 13 while rotating on its axis as the upper turn table 12 and the lower turn table 11 are rotated by a non-illustrated driving source. At this time, the semiconductor wafer W is held in the holding hole 21 of the carrier base 9, and its both surfaces are simultaneously polished by the upper and lower polishing pads 11*a* and 12*a*. At the time of polishing, a polishing liquid is supplied from a nozzle 15 via a through hole 16.

It is to be noted that each carrier holds and polishes one wafer in FIG. 2, but each carrier having a plurality of holding holes may be utilized to hold and polishing a wafer therein.

Here, the carrier for a double-side polishing apparatus 22 according to the present invention has an upwardly opening tapered surface at an inner peripheral end portion of the holding hole 21 as depicted in FIGS. 3(A) and (B), and a ring-like resin insert 20 having a reverse tapered surface with respect to this tapered surface at an outer peripheral portion is fitted into the holding hole 21 via the tapered surface.

As depicted in FIG. 3(C), in a conventional carrier for a double-side polishing apparatus, a resin insert 30 is fitted into a tally portion having a wedge shape to be fixed in order to prevent coming off. However, when disposing the resin insert 30, the tally portion of a carrier base 31 is deformed in some cases.

On the other hand, in such a carrier for a double-side polishing apparatus according to the present invention depicted in FIGS. 3(A) and (B), the resin insert can be readily disposed to the carrier base, the carrier base is not damaged at the time of disposing, the resin insert is fitted in via the tapered surface, and the resin insert can be thereby prevented from coming off at the time of processing and conveyance. Therefore, the carrier base is not deformed during disposing, and a semiconductor wafer having high flatness can be provided in subsequent polishing. Further, start-up polishing of the carrier may be omitted after disposing the resin insert. In addition, even in case of performing the start-up polishing, the metallic carrier base does not have to be polished practically and the carrier having high flatness can be obtained from the polishing performed in a short time since no deformation is observed. Furthermore, providing the tapered shape enables reducing a region of the resin insert that is observed in a lower portion, and an amount of polishing the resin insert on the lower turn table side is decreased at the time of polishing, thereby prolonging a life of the resin insert.

As a shape of the resin insert 20 at this time, such a triangular cross-sectional shape as depicted in FIG. 3(A) or such a trapezoidal cross-sectional shape as shown in FIG. 3(B) may be used.

Moreover, it is preferable for the tapered surface of the inner peripheral end portion of the holding hole 21 to be inclined at 5° to 85° from a main surface of the carrier base 9. When such an inclination angle range is adopted, the resin insert can be prevented from coming off, and stable polishing can be effected. At this time, for example, when the tapered surface of the holding hole 21 is inclined at 45°, the reverse tapered surface is provided in such a manner that the tapered shape of the outer peripheral portion of the resin insert 20 is inclined at −45°.

Additionally, the tapered surface of the holding hole 21 and the reverse tapered surface of the resin insert 20 may be formed to be attachable/detachable without being fixed so that replacement can be facilitated, or these surfaces may be fixed by using an adhesive. When they are fixed by the adhesive, the resin insert is further stabilized at the time of processing and conveyance.

Further, it is preferable to perform double-side polishing with respect to the carrier 22 having the resin insert 20 fitted in the holding hole 21 of the carrier base 9. When the carrier is subjected to double-side polishing with the resin insert being fitted therein in this manner, the resin insert and the carrier base can have the same thickness to eliminate a step, whereby a semiconductor wafer having higher flatness can be provided when performing double-side polishing to the semiconductor wafer. Furthermore, according to the carrier of the present invention, since the carrier base is not deformed when disposing the resin insert, a time required to effect polishing for starting up the carrier can be reduced.

At this time, as a material of the carrier base 9 of the carrier for a double-side polishing apparatus 22 according to the present invention, an SUS material and others can be used, but titanium is desirable. When titanium is adopted, an impurity having a large diffusion coefficient in a silicon single crystal such as Fe or Ni is not present. Therefore, metal contamination that is a problem in a semiconductor wafer can be suppressed.

Furthermore, it is preferable for the surface of this metallic carrier base 9 to be coated with one of a titanium nitride film and a DLC film. When the surface of the metallic carrier base is coated with one of the titanium nitride film and the DLC (Diamond Like Carbon) film in this manner, hardness is increased to avoid scratches, and foreign particles can be prevented from falling into a polishing slurry, thereby prolonging a carrier life and further suppressing contamination with respect to the wafer.

According to the double-side polishing apparatus including the carrier for a double-side polishing apparatus of the present invention as mentioned above, since the carrier base is prevented from being deformed at the time of disposing the resin insert, the semiconductor wafer can be polished to have high flatness, and a time required for performing carrier start-up polishing can be reduced. Therefore, when double-side polishing using such a carrier for a double-side polishing apparatus of the present invention is performed, the semiconductor wafer having high flatness can be manufactured with excellent productivity.

The present invention will now be described in more detail hereinafter based on an example and a comparative example, but the present invention is not restricted thereto.

Example

Comparative Example

Comparison of Starting Up Carrier

First, a carrier for a double-side polishing apparatus a according to the present invention having a configuration that a tapered surface of a carrier base 9 depicted in FIG. 3(A) is inclined at 60° from a main surface and an outer peripheral portion of a resin insert 20 has a reverse tapered surface at −60° was prepared. Moreover, conventional carrier for a double-side polishing apparatus b and c shown in FIG. 3(C) were also prepared, and start-up processing of these three carriers was effected.

A material obtained by performing DLC coating with respect to titanium was used as a material of the carrier base in each of the carrier for a double-side polishing apparatus a, b and c, and aramid was used as a material of a resin insert.

A double-side polishing apparatus manufactured by Fujikoshi Machinery Corporation was used for carrier start-up processing, each polishing pad (an urethane pad, t=1.3 mm) and a polishing liquid (a colloidal silica) were used as processing conditions, and an upper turn table (−10 to −15 rpm), a lower turn table (30 to 40 rpm), a sun gear (20 to 30 rpm), an internal gear (5 to 9 rpm) and a polishing pressure (100 to 200 g/cm$^2$) were set as apparatus conditions.

A polishing time for start-up processing effected under the above-described conditions was set to 60 minutes×2 (front and back surfaces of each carrier are reversed to uniformly polish both surfaces) with respect to the carriers a and b, and it was set to 900 minutes×2 (front and back surfaces of the carrier are reversed to uniformly polish both surfaces) with respect to the carrier c.

To check a step at a boundary between the metallic carrier base and the resin insert of each of the carrier for a double-side polishing apparatus a, b and c subjected to the start-up processing in this manner, thicknesses of the carrier base and the resin insert were measured by an electronic micrometer and surface roughness was measured by a surface roughness meter (Surftest SJ-400) to check the step. As a result, the step between the carrier base and the resin insert of the carrier a according to the present invention is smaller than that of the convention carrier c subjected to the start-up polishing for a long period of time, and it is not greater than a half of the step of the conventional carrier b subjected to the start-up polishing for the same period of time. Table 1 shows this result.

TABLE 1

| | Carrier | Step between carrier base and resin insert | | | |
|---|---|---|---|---|---|
| | start-up time | Surface roughness meter (step) | | Electronic micrometer | |
| Carrier a | 60 min × 2 | Back | 1.0 μm | Carrier base 775 μm | Step 1 μm |
| | | Front | 1.5 μm | Insert resin 776 μm | |
| Carrier b | 60 min × 2 | Back | 2.0 μm | Carrier base 775 μm | Step 4 μm |
| | | Front | 4.0 μm | Insert resin 779 μm | |
| Carrier c | 900 min × 2 | Back | 1.0 μm | Carrier base 775 μm | Step 1 μm |
| | | Front | 2.0 μm | Insert resin 776 μm | |

(Comparison of Wafer Flatness)

Each of the carrier for a double-side polishing apparatus a, b and c subjected to the start-up processing was utilized to polish both surfaces of each of 100 wafers having a diameter of 300 mm. A double-side polishing apparatus manufactured by Fujikoshi Machinery Corporation, each polishing pad (an urethane pad, t=1.3 mm) and a polishing liquid (a colloidal silica) were used as double-side polishing conditions for the wafers, and an upper turn table (−10 to −15 rpm), a lower turn table (30 to 40 rpm), a sun gear (20 to 30 rpm), an internal gear (5 to 9 rpm), a polishing pressure (100 to 200 g/cm$^2$) and a polishing liquid finer than that for the carrier start-up processing were utilized as apparatus conditions.

Figure 4:
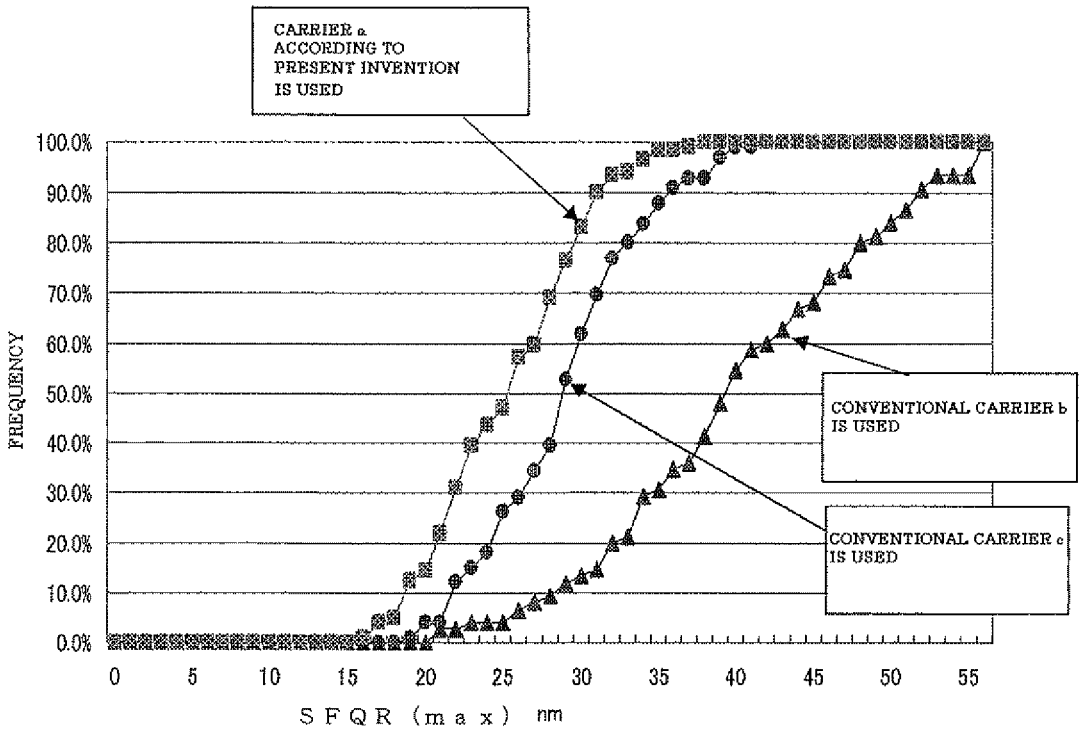
FIG. 4 shows measurement results of examples.

Flatness (SFQR (max)) of a surface of each wafer processed under the above-described conditions was measured by a flatness measuring instrument (WaferSight M49 @mode 26×8/0×0 mm E·Ex=2 mm). FIG. 4 shows this result.

SFQR (site front least squares range) is as follows. An in-site plane is calculated from data for each predetermined site by a least-square method in a state where a wafer back surface is corrected into a plane. The in-site plane is determined as a reference plane. A difference between maximum and minimum displacements from the reference plane for each site means SFQR. The term (max) means a maximum one in such differences for the respective sites.

An average value of each wafer polished by using the carrier a according to the present invention was 25.2 nm, and average values of respective wafers polished by using the conventional carriers b and c were 40.2 nm and 28.8 nm. The flatness obtained by the conventional carrier b having the same start-up polishing time was greatly lower than that of the wafer polished by using the carrier a according to the present invention. Additionally, when the conventional carrier c was utilized to effect polishing, flatness was relatively high, but a start-up polishing time that is 15-fold of that of the carrier a according to the present invention was required. In regard to all the polished wafers, it was revealed that the wafers polished by using the carrier a according to the present invention has high flatness as depicted in FIG. 4 and a shape of a wafer outer peripheral portion of each of these wafers was flat in particular as compared with those obtained by the conventional carriers.

As described above, according to the carrier for a double-side polishing apparatus of the present invention, when disposing the resin insert to the holding hole of the carrier base, since it is fitted in through the tapered surface, the resin insert is prevented from coming off, and the carrier base is not deformed at the time of disposing. Therefore, the semiconductor wafer can be polished to have high flatness at the time of double-side polishing, and the metallic carrier base does not have to be polished for a long time in case of performing carrier start-up processing, whereby a polishing time can be greatly reduced, which leads to an improvement in productivity of the semiconductor wafer.

It is to be noted that the present invention is not restricted to the foregoing embodiment. The foregoing embodiment is just an exemplification, and any examples that have substantially the same configuration and demonstrate the same functions and effects as the technical concept described in claims according to the present invention are included in the technical scope of the present invention.

The invention claimed is:

1. A carrier for a double-side polishing apparatus comprising at least:

a metallic carrier base that is arranged between upper and lower turn tables having polishing pads attached thereto and that has a holding hole formed therein to hold a wafer sandwiched between the upper and lower turn tables at the time of polishing; and a ring-like resin insert that is arranged along an inner peripheral portion of the holding hole of the metallic carrier base and that contacts a peripheral portion of the held wafer, wherein the inner peripheral portion of the holding hole of the metallic carrier base has an upwardly opening tapered surface inclined from a lower main surface to an upper main surface of the metallic carrier base, an outer peripheral portion of the ring-like resin insert has a reverse tapered surface with respect to the tapered surface of the holding hole of the metallic carrier base, the ring-like resin insert is fitted in the holding hole of the metallic carrier base through the tapered surface, and a material of the metallic carrier base is titanium.

2. The carrier for a double-side polishing apparatus according to claim 1, wherein the tapered surface of the holding hole is inclined at 5° to 85° from the lower main surface of the metallic carrier base.

3. The carrier for a double-side polishing apparatus according to claim 1, wherein the tapered surface of the holding hole and the reverse tapered surface of the ring-like resin insert are fixed to each other through an adhesive.

4. The carrier for a double-side polishing apparatus according to claim 2, wherein the tapered surface of the holding hole and the reverse tapered surface of the ring-like resin insert are fixed to each other through an adhesive.

5. The carrier for a double-side polishing apparatus according to claim 1, wherein the carrier having the ring-like resin insert fitted in the holding hole of the metallic carrier base is subjected to double-side polishing.

6. The carrier for a double-side polishing apparatus according to claim 2, wherein the carrier having the ring-like resin insert fitted in the holding hole of the metallic carrier base is subjected to double-side polishing.

7. The carrier for a double-side polishing apparatus according to claim 3, wherein the carrier having the ring-like resin insert fitted in the holding hole of the metallic carrier base is subjected to double-side polishing.

8. The carrier for a double-side polishing apparatus according to claim 4, wherein the carrier having the ring-like resin insert fitted in the holding hole of the metallic carrier base is subjected to double-side polishing.

9. The carrier for a double-side polishing apparatus according to claim 1, wherein a surface of the metallic carrier base is coated with any one of a titanium nitride film and a DLC film.

10. The carrier for a double-side polishing apparatus according to claim 2, wherein a surface of the metallic carrier base is coated with any one of a titanium nitride film and a DLC film.

11. The carrier for a double-side polishing apparatus according to claim 3, wherein a surface of the metallic carrier base is coated with any one of a titanium nitride film and a DLC film.

12. The carrier for a double-side polishing apparatus according to claim 4, wherein a surface of the metallic carrier base is coated with any one of a titanium nitride film and a DLC film.

13. The carrier for a double-side polishing apparatus according to claim 5, wherein a surface of the metallic carrier base is coated with any one of a titanium nitride film and a DLC film.

14. The carrier for a double-side polishing apparatus according to claim 6, wherein a surface of the metallic carrier base is coated with any one of a titanium nitride film and a DLC film.

15. The carrier for a double-side polishing apparatus according to claim 7, wherein a surface of the metallic carrier base is coated with any one of a titanium nitride film and a DLC film.

16. The carrier for a double-side polishing apparatus according to claim 8, wherein a surface of the metallic carrier base is coated with any one of a titanium nitride film and a DLC film.

17. A double-side polishing apparatus including at least the carrier for a double-side polishing apparatus according to claim 1.

18. A semiconductor wafer double-side polishing method that is a method for performing double-side polishing with respect to a semiconductor wafer, comprising:

arranging the carrier according to claim 9 between upper and lower turn tables having polishing pads attached thereto;

holding the semiconductor wafer in a holding hole formed in the carrier; and sandwiching the semiconductor wafer between the upper and lower turn tables to be subjected to double-side polishing.

19. A carrier for a double-side polishing apparatus comprising at least:

a metallic carrier base that is arranged between upper and lower turn tables having polishing pads attached thereto and that has a holding hole formed therein to hold a wafer sandwiched between the upper and lower turn tables at the time of polishing; and a ring-like resin insert that is arranged along an inner peripheral portion of the holding hole of the metallic carrier base and that contacts a peripheral portion of the held wafer, wherein the inner peripheral portion of the holding hole of the metallic carrier base has an upwardly opening tapered surface inclined from a lower main surface to an upper main surface of the metallic carrier base such that a diameter of the holding hole continuously increases from a first end of the holding hole adjacent to the lower main surface to a second end of the holding hole adjacent to the upper main surface, an outer peripheral portion of the ring-like resin insert has a reverse tapered surface with respect to the tapered surface of the holding hole of the metallic carrier base, the ring-like resin insert is fitted in the holding hole of the metallic carrier base through the tapered surface, and a material of the metallic carrier base is titanium.

* * * * *